US006270324B1

(12) United States Patent
Sullivan et al.

(10) Patent No.: US 6,270,324 B1
(45) Date of Patent: Aug. 7, 2001

(54) POSITIVE DISPLACEMENT PUMP AND THRUST BEARING ASSEMBLY

(75) Inventors: Michael G. Sullivan, Plainfield; Matthew Turina, Matteson, both of IL (US)

(73) Assignee: Tuthill Corp., Alsip, IL (US)

( * ) Notice: Subject to any disclaimer, the term of this patent is extended or adjusted under 35 U.S.C. 154(b) by 0 days.

(21) Appl. No.: 09/427,303

(22) Filed: Oct. 26, 1999

(51) Int. Cl.[7] ..... F04B 17/00
(52) U.S. Cl. ..... 417/420
(58) Field of Search ..... 417/420, 365, 417/410.3, 375; 384/420, 248

(56) References Cited

U.S. PATENT DOCUMENTS

| | | | | |
|---|---|---|---|---|
| 3,664,758 | * | 5/1972 | Sato | 415/104 |
| 3,736,075 | | 5/1973 | Otto et al. . | |
| 4,013,384 | | 3/1977 | Oikawa et al. . | |
| 4,036,565 | * | 7/1977 | Becker | 417/420 |
| 4,047,847 | * | 9/1977 | Oikawa | 417/370 |
| 4,065,235 | * | 12/1977 | Furlong et al. | 417/420 |
| 4,080,112 | | 3/1978 | Zimmerman et al. . | |
| 4,407,641 | * | 10/1983 | Long | 417/356 |
| 4,487,557 | * | 12/1984 | Ruyak et al. . | |
| 4,871,301 | | 10/1989 | Buse et al. . | |
| 5,160,246 | | 11/1992 | Horiuchi et al. . | |
| 5,165,868 | | 11/1992 | Gergets et al. . | |
| 5,256,038 | * | 10/1993 | Fairman | 417/423.11 |
| 5,263,829 | | 11/1993 | Gergets et al. . | |
| 5,494,416 | | 2/1996 | Gergets et al. . | |

* cited by examiner

*Primary Examiner*—Teresa Walberg
*Assistant Examiner*—Daniel Robinson
(74) *Attorney, Agent, or Firm*—Lee, Mann, Smith, McWilliams, Sweeney and Ohlson

(57) ABSTRACT

A positive displacement pump and thrust bearing assembly having a housing defining an internal fluid chamber having front and rear inner walls. A rotor having a front face and a rear face is positioned in the fluid chamber. Each of the faces of the rotor is spaced apart from a corresponding inner wall of the fluid chamber to define predetermined clearances therebetween. A shaft is connected at a first end to the rotor to effect rotation thereof. The shaft extends through a bore in the housing. The thrust bearing assembly includes an adjusting collar and a thrust bushing. The adjusting collar is attachable to the shaft and includes a central bore through which the shaft extends. The thrust bushing is secured within the bore of the housing by a locking ring that prevents longitudinal movement of the thrust bushing toward the fluid chamber. The adjusting collar is rotatable with the shaft and is in relative rotatable engagement with the thrust bushing. The adjusting collar and the thrust bushing prevent movement of the shaft and the rotor in a direction away from the adjusting sleeve and toward the rear inner wall of the fluid chamber such that the predetermined clearances between the faces of the rotor and the internal walls of the housing are substantially uniformly maintained as the rotor rotates.

12 Claims, 1 Drawing Sheet

POSITIVE DISPLACEMENT PUMP AND THRUST BEARING ASSEMBLY

BACKGROUND OF THE INVENTION

The present invention relates to a positive displacement pump and thrust bearing assembly and in particular to a positive displacement pump having a thrust bearing assembly located in communication with the fluid chamber of the pump for controlling rotor clearances between the cover and bracket faces of the fluid chamber.

The optimum clearances between the rotor and the cover and bracket faces in a positive displacement pump must be closely maintained during operation of the pump as these clearances are critical to providing a consistent flow of fluid from the pump. Centrifugal pumps, as opposed to positive displacement pumps, do not require that clearances between the rotor and the cover and bracket faces of the pump fluid chamber be as closely maintained during operation in order to provide a consistent flow of fluid from a centrifugal pump. Magnetically driven positive displacement pumps are shown and described in U.S. Pat. No. 5,165,868, issued Nov. 24, 1992, U.S. Pat. No. 5,263,829, issued Nov. 23, 1993 and U.S. Pat. No. 5,494,416, issued Feb. 27, 1996, all of which are assigned to Tuthill Corporation.

During operation of a positive displacement gear pump the rotor may be pushed towards the cover of the pump by a thrust force created by hydraulic loading on the rotor. The hydraulic loading on the rotor and the resulting thrust force are inherent in the design and operation of a positive displacement gear pump. The magnitude of the thrust force pushing the rotor towards the cover increases as the diameter of the rotor increases and as the pressure of the pumped fluid increases. As the rotor is pushed towards the cover, the clearances between the rotor and the cover and bracket faces of the pump chamber are changed thereby changing the operating efficiency of the pump. The rotor may also be forced into contact with the cover resulting in damage to the pump. The use of a thrust bearing in a positive displacement pump is made additionally difficult due to the exposure of the thrust bearing to the pumped fluid which may contain particulates or which may have poor lubricating qualities resulting in premature wear to the bearing.

SUMMARY OF THE INVENTION

The present invention is directed to an improved thrust bearing assembly for a positive displacement pump. The pump includes a housing defining an internal fluid chamber having front and rear inner walls and a rotor positioned in the fluid chamber for rotation therein. The rotor includes a front face and a rear face, with each rotor face being spaced apart from a corresponding inner wall of the fluid chamber to define a predetermined clearance therebetween. A shaft is connected at one end of the rotor to provide rotation. The shaft extends through a bore within a bracket.

The thrust bearing assembly includes an adjusting collar, a retainer and a thrust bushing. The thrust bushing is positioned within the bore through which the shaft extends and is prevented from moving axially toward the cover of the fluid chamber by a retainer positioned within the bore. The retainer prevents longitudinal movement of the thrust bushing within the bore. An interference fit prevents rotation of the bushing. The bushing radially supports the shaft. The adjusting collar is selectively attachable to the shaft and includes a central bore through which the shaft extends. The adjusting collar includes a circular wall which extends around the shaft. The adjusting collar is connected to the shaft for rotation therewith such that an annular surface of the circular wall of the adjusting collar is in relative rotatable engagement with an annular surface of the bushing. The interaction of the adjusting collar and the bushing prevent movement of the shaft and the rotor in a longitudinal direction toward the cover of the fluid chamber such that the predetermined clearances between the faces of the rotor and the cover and bracket faces are substantially uniformly maintained as the rotor rotates.

DESCRIPTION OF THE PREFERRED EMBODIMENT

Figure 1:
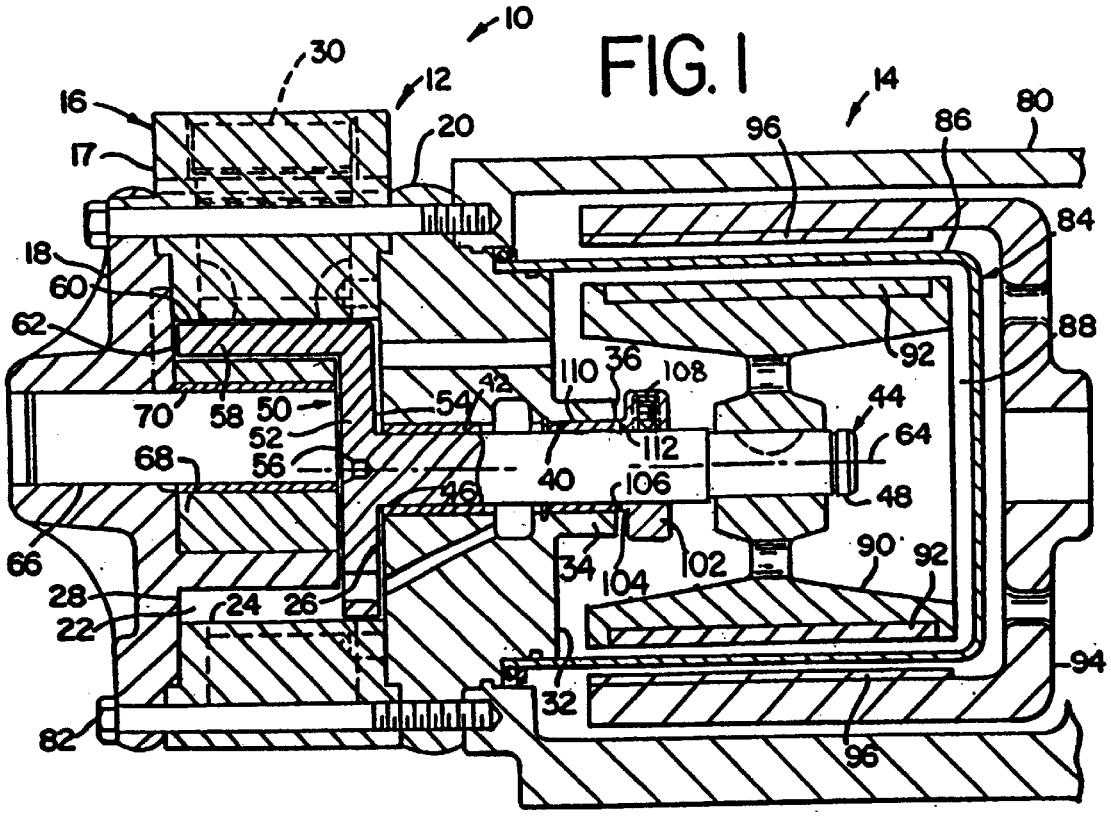
FIG. 1 is a partial cross-sectional view of a magnetically driven positive displacement pump and thrust bearing assembly.

FIG. 1 shows a magnetically driven positive displacement pump 10 including a positive displacement pump unit 12 coupled to a magnetic drive unit 14. The positive displacement pump unit 12 and the magnetic drive unit 14 are constructed and operate as generally shown and described in U.S. Pat. No. 5,165,868, issued Nov. 24, 1992, U.S. Pat. No. 5,263,829, issued Nov. 23, 1993 and U.S. Pat. No. 5,494,416, issued Feb. 27, 1996, all of which are incorporated herein by reference. Although a magnetic driven pump is one type of positive displacement pump in which the thrust bearing assembly is designed to operate, the assembly may be used in other types of positive displacement pumps.

The positive displacement pump unit 12 includes a housing 16, a cover 18 attached to the left side of the housing 16 and a bracket 20 attached to the right side of the housing 16. An internal fluid chamber 22 is formed within the housing 16 between the cover 18 and the bracket 20. The internal fluid chamber 22 is formed by a sidewall 24 located on the housing 16, a rear inner wall 26 located on the bracket 20 and a front inner wall 28 located on the cover 18. The housing 16 includes an inlet port (not shown) and an outlet port 30 shown in phantom in FIG. 1 both of which are in communication with the fluid chamber 22.

The bracket 20 also includes an outer wall 32 and a generally cylindrical stem 34 projecting perpendicularly outwardly from the outer wall 32. The stem 34 is cylindrical and has an annular end surface 36 and a bore 40 which extends concentrically within the stem 34 and through the bracket 20. A bushing 42 is located within the bore 40 near the fluid chamber 22.

The positive displacement pump unit 12 also includes a shaft 44 having a first end 46 and a second end 48. The shaft 44 extends through the bore 40 in the bracket 20 and is rotatably supported by the bushing 42. A rotor 50 is attached to the first end 46 of the shaft 44 and is located in the fluid chamber 22. The rotor 50 includes a generally circular base 52 having a rear face surface 54 which is spaced apart from and parallel to the rear inner wall 26 of the bracket 20 and a back wall surface 56. The rotor 50 also includes an outer gear 58 which extends outwardly from the edge of the base 52 generally parallel to the shaft 44. The outer gear 58 includes an external surface 60 which is spaced apart from the inner side wall 24 of the housing 16 and a front face surface 62 which is spaced apart from the front inner wall 28 of the cover 18. The clearances between the surfaces of the rotor and the internal walls of the housing 16 which form the fluid chamber 22 are shown in an exaggerated scale in FIG.

1 for purposes of illustration. The shaft 44 and the rotor 50 rotate about an axis 64 which extends longitudinally through the center of the shaft 44. A stationary pin 66 extends inwardly into the fluid chamber 22 from the cover 18. An inner gear 68 is rotatably attached to the stationary pin 66 by a bushing 70. The inner gear 68 engages the outer gear 58 in a conventional manner to provide the appropriate pumping effect.

The magnetic drive unit 14 includes an adapter casing 80 which is connected to the positive displacement pump unit 12 by fasteners 82. A sealed container 84 having a cylindrical peripheral wall member 86 is attached to the bracket 20 of the pump unit 12 and is sealed thereto. The sealed container 84 forms a cooling fluid chamber 88 therein and encloses the second end 48 of the shaft 44 in conjunction with the bracket 20. The cooling fluid chamber 88 is in fluid communication with the internal pump fluid chamber 22 in the housing 16 through a fluid path extending along the shaft 44 as described and illustrated more fully in U.S. Pat. No. 5,165,868. Additional fluid passages may be included between the cooling fluid chamber 88 and the pump fluid chamber 22 if desired. A rotary driven member 90 is located within the sealed container 84 and is connected to the second end 48 of the shaft 44 for conjoint rotation therewith. The rotary driven member 90 includes a first magnetic surface 92 extending along and spaced apart from the interior of the peripheral wall 86 of the sealed container 84. A cup-shaped rotary drive member 94 having a recess therein extends around the sealed container 84 such that the rotary driven member 90 is located within the recess of the rotary drive member 94. The rotary drive member 94 includes a second magnetic surface 96 extending along and spaced apart from the exterior of the peripheral wall 86 of the sealed container 84 for magnetic engagement with the first magnetic surface 92 of the rotary driven member 90. The remaining construction and operation of the magnetic drive unit 14 is substantially as shown and described in U.S. Pat. No. 5,165,868.

Figure 2:
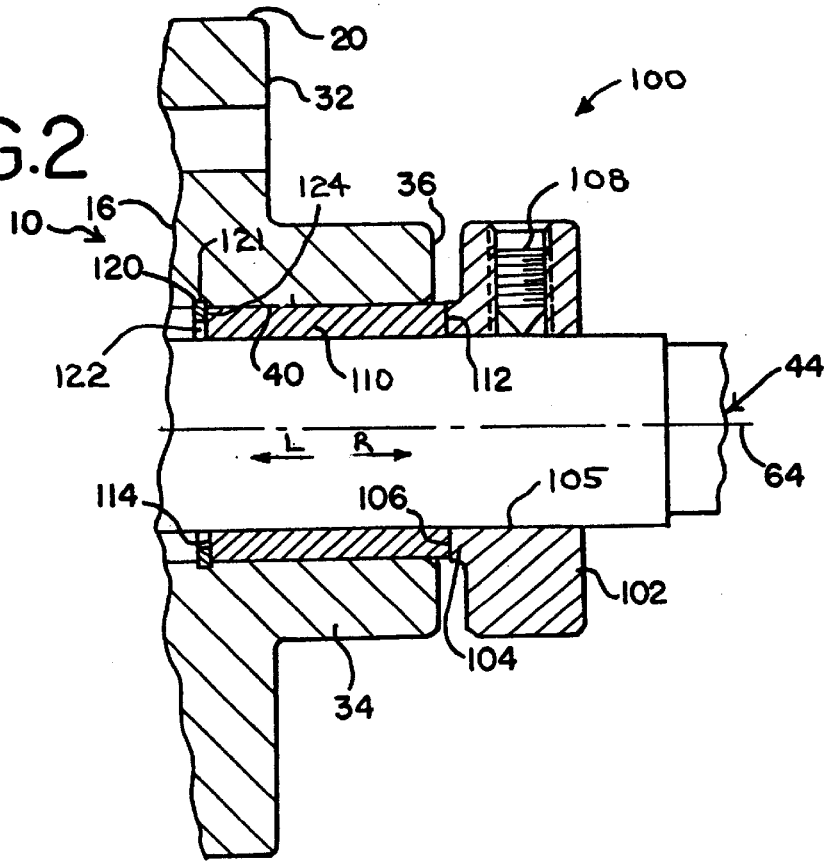
FIG. 2 is an enlarged partial cross-sectional view of the thrust bearing assembly.

As best shown in FIG. 2, the positive displacement pump 10 also includes a thrust bearing assembly 100. The purpose of the thrust bearing assembly is to initially provide for setting of the clearances between the rotor 50 and the walls of the fluid chamber 22 to predetermined values and thereafter to maintain these clearances during operation of the pump 10. The thrust bearing assembly 100 includes an adjusting collar 102 having a circular stem portion 104 and a central bore 105 therethrough. The stem portion 104 includes an annular bearing surface 106. The shaft 44 extends through the bore 105 of the adjusting collar 102. The adjusting collar 102 is longitudinally adjustable along the shaft 44 and is then secured to the shaft 44 by one or more set screws 108 threadably engaged with the adjusting collar 102 and adapted for selective engagement with the shaft 44. The set screws 108 selectively provide a rigid connection between the adjusting collar 102 and the shaft 44 to prevent any movement therebetween.

The thrust bearing assembly 100 also includes a thrust bushing 110 positioned within the bore 40 of the bracket 20. Preferably, the thrust bushing 110 is press fit within the bore 40. The thrust bushing 110 rotatably supports the shaft 44 along with the bushing 42 previously described herein. The thrust bushing 110 has two annular bearing surfaces 112 and 114. Longitudinal movement of the thrust bushing 110 back towards the fluid chamber 22 is prevented by a locking ring 120 that is positioned within the bore 40. The locking ring 120 is captured by an annular detent 121 within the bore 40, which fixes the longitudinal position of the locking ring 120 within the bore 40. The locking ring 120 has a circular aperture 122 that allows the shaft 44 to extend therethrough. The locking ring 120 has an annular bearing surface 124 that bears against the annular bearing surface 114 of the bushing 110, thereby preventing longitudinal movement of the thrust bushing 110 back toward the fluid chamber 22. The press fit between the thrust bushing 110 and the bore 40 further provides resistance to longitudinal movement of the thrust bearing 110 within the bore 40.

The thrust bushing 110 is positioned within the bore 40 such that the annular bearing surface 112 is outwardly offset from the annular end surface 36 of the stem 34. The annular bearing surface 112 of the thrust bushing 110 bears against the annular bearing surface 106 of the adjusting collar 102 which is secured to the shaft 44, thereby maintaining proper longitudinal positioning of the shaft 44 within the housing 16. The thrust bushing 110 is preferably made of carbon, although other materials such as ceramic, tungsten carbide, silicon carbide or NI-Resist may be used depending upon the type of fluid located within the cooling fluid chamber 88.

The pump 10 operates at optimum efficiency and provides a consistent flow of fluid from the outlet 30 of the pump unit 12 when the clearance between the rear face 54 of the rotor 50 and the rear inner wall 26 of the fluid chamber 22, and the clearance between the front face 62 of the rotor 50 and the front inner wall 28 of the fluid chamber 22, are maintained at generally constant pre-determined distances as the rotor 50 rotates about the axis 64. During assembly of the pump 10, the adjusting collar 102 is placed over the second end 48 of the shaft 44 such that the shaft 44 extends through the bore 105 in the adjusting collar 102. The adjusting collar 102 is moved along the shaft 44 and is loosely placed adjacent to the annular bearing surface 112 of the thrust bushing 110. The position of the shaft 44 and the rotor 50 may be axially adjusted with the use of feeler gauges to provide the proper predetermined clearances between the faces 54 and 62 of the rotor 50 and the inner walls 26 and 28 of the fluid chamber 22 by axially moving the shaft 44 and the rotor 50 in the required direction parallel to the axis 64, either to the left as indicated by the arrow "L" or the right as indicated by the arrow "R" in FIG. 2. Once the shaft 44 and rotor 50 have been positioned to provide the optimum predetermined clearances between the faces 54 and 62 of the rotor 50 and the inner walls 26 and 28 of the fluid chamber 22, the adjusting collar 102 is moved along the shaft 44 toward the adjusting plate 104, while the rotor 50 and shaft 44 remain stationary, until the annular bearing surface 106 of the adjusting collar 102 comes into contact with the annular bearing surface 112 of the thrust bushing 110. The set screws 108 are then tightened against the shaft 44 to rigidly connect the adjusting collar 102 to the shaft 44 such that the adjusting collar 102 cannot rotate about the shaft 44 or move axially therealong.

During operation of the pump 10, the pumping action provided by the rotation of the rotor 50 creates a hydraulic thrust force on the rotor 50 which tends to push the rotor 50 generally parallel to the axis 64 in a direction toward the cover 18. This thrust force attempts to decrease the clearance between the front face 62 of the rotor 50 and the front inner wall 28 of the fluid chamber 22, and increase the clearance between the rear face 54 of the rotor 50 and the rear inner wall 26 of the fluid chamber 22. Any such changes in clearance would be detrimental to the operation of the pump 10. The thrust force, if unresisted, may even push the rotor 50 into contact with the cover 18 such that the rotor 50 will score the cover 18 and otherwise cause damage to the rotor 50 and pump 10.

The thrust force which is applied to the rotor 50 during operation of the pump 10 is resisted by the thrust bearing assembly 100 and specifically by the engagement of the annular bearing surface 106 of the adjusting collar 102 with the annular bearing surface 112 of the thrust bushing 110. The adjusting collar 102 prevents movement of the shaft 44 and the rotor 50 in a longitudinal direction towards the cover 18 and away from the adjusting collar 102. The thrust bearing assembly 100 thereby maintains substantially uniform clearances between the rotor 50 and the inner walls 26 and 28 of the fluid chamber 22 as the rotor 50 rotates during pumping operations. While the adjusting collar 102 prevents movement of the shaft 44 and rotor 50 in a longitudinal direction toward the cover 18 as shown by the arrow "L", the annular bearing surface 106 of the adjusting collar 102 and the annular bearing surface 112 of the thrust bushing 110 are in rotatable engagement with one another thereby allowing rotation of the shaft 44 and the adjusting collar 102 with respect to the thrust bushing 110. The fluid within the cooling fluid chamber 88 provides lubrication between the annular bearing surface 106 of the adjusting collar 102 and the annular bearing surface 112 of the thrust bushing 110.

Various features of the invention have been particularly shown and described in connection with the illustrated embodiment of the invention, however, it must be understood that these particular arrangements merely illustrate, and that the invention must be given its fullest interpretation within the terms of the appended claims.

What is claimed is:

1. A pumping assembly comprising:

a positive displacement pump with a bracket and a housing defining an internal fluid chamber having front and rear inner walls;

a rotor positioned in said fluid chamber, said rotor having a front face and a rear face, each of said faces spaced apart from a corresponding inner wall of said fluid chamber to define predetermined clearances therebetween;

a shaft having a first end connected to said rotor to effect rotation thereof;

a thrust bearing assembly including a bushing, an adjusting collar, and a retaining device, said bushing concentrically positioned within a central bore of said bracket such that said shaft extends through and rotates within said bushing, said retaining device connected to said bracket, and positioned within said bore, adapted to engage said bushing and prevent relative axial movement of said bushing within said bore toward said fluid chamber, said adjusting collar being connectable to said shaft for rotation therewith, said adjusting collar adapted to engage said bushing thereby preventing axial movement of said shaft toward said chamber such that said predetermined clearances between said faces of said rotor and said inner walls of said chamber are substantially uniformly maintained as said rotor rotates, notwithstanding forces urging axial movement of said shaft toward said fluid chamber.

2. A pumping assembly as in claim 1 including a sealed container surrounding and enclosing a second end of said shaft, the interior of said container being in communication with said fluid, said thrust bearing assembly positioned within said container.

3. The pumping assembly of claim 2 including a rotary driven member attached to said second end of said shaft for rotation therewith; a first magnetic surface carried by said driven member; a rotary drive member defining a recess therein, said driven member being located within said recess for rotation; a second magnetic surface carried by said drive member; said sealed container having a peripheral wall member disposed between said drive member and said driven member and enclosing said adjusting collar.

4. The pumping assembly of claim 1, wherein said bushing is press fit within said bore.

5. The pumping assembly of claim 1, wherein said bushing is made of a carbon material.

6. The pumping assembly of claim 1 including means for releasably attaching said adjusting collar to said shaft such that said collar is adjustably positionable laterally along said shaft prior to attachment to said shaft.

7. The pumping assembly of claim 6, wherein said releasable attachment means comprises a set screw threadably attached to said adjustment collar, said set screw being selectively engageable with said shaft.

8. The pumping assembly of claim 1, wherein said retaining device comprises a generally flat ring having a circular aperture therethrough.

9. The pumping assembly of claim 8, wherein said ring engages an annular detent within said bore.

10. The pumping assembly of claim 1, wherein said housing includes an outwardly projecting stem having an annular end surface and said bushing includes an annular bearing surface outwardly offset from said annular end surface of said stem.

11. The pumping assembly of claim 10, wherein said adjusting collar includes a stem portion having an annular bearing surface, said annular bearing surface of said stem portion being in relative rotatable engagement with said annular bearing surface of said bushing during operation of said pumping assembly.

12. A pumping assembly including a positive displacement pump with a bracket and a housing defining an internal fluid chamber having front and rear inner walls;

a rotor positioned in said fluid chamber, said rotor having a front face and a rear face, each of said faces spaced apart from a corresponding inner wall of said fluid chamber to define predetermined clearances therebetween;

a shaft having a first end connected to said rotor to effect rotation thereof; and a thrust bearing assembly including a bushing, an adjusting collar, and a retaining device, said bushing concentrically positioned within a central bore of said bracket such that a portion of said bushing extends outside said bore in a direction away from said chamber and such that said shaft extends through and rotates within said bore and said bushing, said retaining device positioned within an annular detent within said bore, said retaining device adapted to prevent relative longitudinal movement of said bushing within said bore toward said fluid chamber, said adjusting collar being connectable to said shaft for rotation therewith such that said adjusting collar is in relative rotatable engagement with said extending portion of said bushing preventing axial movement of said shaft toward said chamber and such that said predetermined clearances between said faces of said rotor and said inner walls of said chamber are substantially uniformly maintained as said rotor rotates notwithstanding forces urging axial movement of said shaft.

* * * * *